US006584798B2

(12) United States Patent
Schegerin

(10) Patent No.: US 6,584,798 B2
(45) Date of Patent: Jul. 1, 2003

(54) INDIVIDUAL COOLING SYSTEM

(76) Inventor: Robert Schegerin, c/o Eurodeffi-Brevet, Boite postale 20, 12, avenue de l'Europe, F-78142 Velizy Cedex (FR)

( * ) Notice: Subject to any disclaimer, the term of this patent is extended or adjusted under 35 U.S.C. 154(b) by 0 days.

(21) Appl. No.: 10/222,967

(22) Filed: Aug. 19, 2002

(65) Prior Publication Data

US 2003/0029186 A1 Feb. 13, 2003

Related U.S. Application Data

(63) Continuation of application No. PCT/FR01/00466, filed on Feb. 16, 2001.

(51) Int. Cl.[7] ..... B67D 5/62; F25D 19/00

(52) U.S. Cl. ..... 62/386; 62/299; 62/4; 62/530; 62/259.3; 62/261

(58) Field of Search ..... 62/259.3, 261, 62/385, 299, 4, 530

(56) References Cited

U.S. PATENT DOCUMENTS

| | | | | |
|---|---|---|---|---|
| 3,610,323 A | * | 10/1971 | Troyer | 165/46 |
| 3,670,518 A | | 6/1972 | Esposito | |
| 4,191,028 A | | 3/1980 | Audet et al. | |
| 4,718,429 A | * | 1/1988 | Smidt | 128/400 |
| 4,998,415 A | * | 3/1991 | Larson | 62/231 |
| 5,201,365 A | * | 4/1993 | Siegel | 165/46 |
| 5,386,823 A | * | 2/1995 | Chen | 128/204.15 |
| 5,438,707 A | * | 8/1995 | Horn | 2/69 |
| 6,074,414 A | * | 6/2000 | Haas et al. | 607/108 |
| 6,105,382 A | * | 8/2000 | Reason | 62/259.3 |
| 6,125,645 A | * | 10/2000 | Horn | 62/259.3 |
| 6,126,683 A | * | 10/2000 | Momtaheni | 607/109 |

FOREIGN PATENT DOCUMENTS

| | | |
|---|---|---|
| EP | 0 076 079 | 4/1983 |
| EP | 0 348 835 | 1/1990 |
| EP | 0 490 347 A1 | 6/1992 |
| EP | 0 570 301 A1 | 11/1993 |
| FR | 2 619 315 | 2/1989 |
| FR | 2 621 459 | 4/1989 |
| FR | 2 706 740 | 12/1994 |
| FR | 2 742 852 | 6/1997 |
| FR | 2 778 231 | 11/1999 |
| GB | 1 376 604 | 12/1974 |
| GB | 2 032 255 A | 5/1980 |
| WO | WO 91/04722 | 4/1991 |

* cited by examiner

*Primary Examiner*—William C. Doerrler
*Assistant Examiner*—Mark Shulman
(74) *Attorney, Agent, or Firm*—Larson & Taylor PLC

(57) ABSTRACT

The present invention concerns an Individual cooling system comprising: (a) a garment V; (b) a container containing a block of material liberating an amount of cooling energy by phase change; (c) a pump P. The invention characterized in that it comprises means enabling the continuous operation of the assembly without solidification of the heating medium, even if the solidification temperature of the heating medium is higher than the temperature of the block of material releasing the cooling energy by phase change.

20 Claims, 2 Drawing Sheets

INDIVIDUAL COOLING SYSTEM

CROSS-REFERENCE TO RELATED APPLICATIONS

This application is a continuation of International PCT Application No. PCT/FR01/00466, filed on Feb. 16, 2001, designating the U.S.

BACKGROUND OF THE INVENTION

When the metabolic activity is important and/or when humidity and temperature conditions are difficult it is necessary to bring an active cooling to the subject.

Many systems exist allowing the transfer of cooling energy to a subject.

The patent FR-26 19 315 dated Feb. 17, 1981 concerns a garment maintained under light pressure by a gas, for example CO2, contained in a container under pressure. It does not allow cooling of the subject efficiently.

The patent EP-03 48 835 A2 of Jan. 3, 1993 concerns a garment protecting against accelerations comprising a fluid capable of transporting cooling energy circulating through a heat exchanger. The presence of a different fluid and a heat exchanger induces global losses and added supplementary costs.

The patent WO 91 04 722 A1 of Apr. 18, 1991 concerns a device for cooling of a body by evaporation of liquid on the external face of the garment. It does not allow cooling of a subject placed inside a seal tight garment, or in an humid atmosphere.

The patent EP 057 0301 A1 of Nov. 18, 1993 concerns a device that destroys body cells by applying ultra cold substances. This device does not allow cooling of a human being.

The patent EP 04 90 347 of Jun. 17, 1992 concerns a vest placed at some distance from the skin and comprising a ventilation of air allowing cooling of the subject. This system does not allow cooling of the subject when the air is hot and humid.

The patent FR 27 06 740 of Dec. 30, 1994 concerns a refrigerant composite material whose functioning is based on a chemical reversible reaction between a solid and a gas. This system is not effective and very heavy.

The patent FR 26 21 459 of Apr. 14, 1989 comprises a source of cooling energy packed and supplied by an elastic opening system. This system does not allow a cooling of the homogeneous body and is not adaptable.

The company DRAEGER has proposed a cooling system based on carbon dioxide comprising a fluid (oil and silicone based) moved by a pump making the fluid pass successively in the garment and in a heat exchanger placed near the solid block of carbon dioxide. The utilization of oil and silicone based fluid that solidifies at very low temperature introduces problems and generates extra costs and performance losses that increases the mass of the pump and batteries. This solution is unusable since it leads to a system having a mass and cost way above potential users expectations.

The company INTERTECHNIQUE has proposed a solution using liquid air placed in a reservoir and cooling the subject using a heat exchanger. This solution leads to a very heavy system, dangerous and very expensive.

The French patent no. 98 05 374 allows to realize some blocks? every day on site but do not solve the problem to have an efficient and usable complete system for a great number of individuals displaced in operation.

The French patent no. 95 15 234 is a portable system comprising a reservoir under pressure. This reservoir has to be leak tight and resistant to internal pressures. It is therefore, heavy, more expensive and dangerous.

None of the solutions proposed in the past allows one to realize a simple, light, safe, and economical system.

In fact it can be noticed that it is very difficult to cool a human being because the skin is at about 34 degrees Celsius approximately and does not tolerate the contact of too low temperatures.

SUMMARY OF THE INVENTION

The utilization of the cooling power coming from the sublimation of solid carbon dioxide has necessitated many tests, but has now lead to the realization of an effective prototype.

The present invention aims to provide a system allowing to cool one individual or several persons efficiently, in comfort and for a minimal mass and a minimal cost.

The carbon dioxide, during sublimation, liberates an important cooling energy (627 kilojoules by kilogram). This cooling energy can be used efficiently to cool a subject that is too hot. The fundamental problem is the optimal transfer of this available cooling energy to the human bodies while respecting the physiological limits of the human body.

A goal of the invention is to realize a complete system allowing the comfortable and efficient cooling of one or several individuals, this system being light, portable, safe and having a low operating cost.

These goals are achieved by the individual cooling system, according to the invention comprising:

at least a garment V worn near the body comprising several fine pipes in which circulates a fluid carrying the cooling energy and solidifying at the temperature TF and bringing the cooling energy to the subject, this garment having characteristics of pressure drop as a function of the flow following the relation $$D=F1(PE-PS)$$

Where D is the flow of the fluid in the garment

PE is the pressure at the entry of the garment

PS is the pressure at the exit of the garment

F1 is the function that links the flow and the pressure drop of the garment at least a thermally insulating container containing a substance liberating a quantity of cooling energy QE by phase change at a temperature TCP and containing a heat exchanger E2 having the following characteristics of flow as a function of pressure drop:

$$D=F2(PC-PF)$$

Where

D is the flow of fluid carrying the thermal energy

PC is the fluid pressure at the container entry

PF is the fluid pressure at the container exit

F2 is the function that links the flow and the pressure drop of the container at least a pump P moving the fluid carrying thermal energy in the circuit E1 of the garment V and in the heat exchanger E2 of the container, this pump having the following characteristics of flow as a function of differential pressure:

$$D=F3(PF-PA)$$

Where

D is the flow of the fluid carrying thermal energy in the pump P

PA is the pressure at the entry of the pump P

PF is the pressure at the exit of the pump P

F3 is the function that links the flow and the differential pressure of the pump P characterized by the presence of at least a device allowing the continuous functioning in of the system without solidification of the fluid carrying the thermal energy, although the temperature of solidification TF of this fluid is superior at least by more than 10 degree Celsius of the temperature of the block B of substance liberating the cooling energy by phase change.

It is advantageous that one of the said devices comprises an assembly of walls, constituting the heat exchangers E1 and E2, having thermal characteristics calibrated in function of characteristics of the pump P and pressure drop of circuit of the garment and the container, in such a way that the coefficient K1 is three to ten times superior to K2 where $$K1=s1/((e1)(ct1))$$

where s1 is the surface of exchange of the heat exchanger E1 e1 is the thickness of walls of the heat exchanger E1 ct1 is the thermal exchange coefficient of the material constituting the heat exchanger E1 and where $$K2=s2/((e2)(ct2))$$

where s2 is the surface of exchange of the heat exchanger E2 e2 is the thickness of walls of the heat exchanger E2 ct2 is the thermal exchange coefficient of the material constituting heat exchanger E2, in order that the fluid carrying the thermal energy, in normal use, never reaches its solidification temperature while allowing a satisfying transfer of the cooling energy from the block to the human body.

It is advantageous that said heat exchanger E2 comprises a circuit where the pipes are placed in such a way that the fluid at low temperature and the fluid relatively warmer having circulated in the vest are placed side by side so that the average local temperature is as constant as possible at every point of the heat exchanger.

It is advantageous that the fluid carrying thermal energy is a mixture of water and antifreeze having an solidification temperature equal to −35° C. while the carbon dioxide contained in the container is at a temperature equal to −78° C.

It is advantageous that said container is placed in a vehicle comprising a quick connector for connecting and disconnecting the vest from the container a device allowing the fluid carrying the thermal energy not to solidify in case of disconnection.

It is advantageous that the said device allowing the fluid carrying the thermal energy not to solidify in case of disconnection, comprises a circuit in parallel comprising a valve having a threshold of opening between 0.25 bar and 1 bar an heat exchanger allowing to evacuate automatically the excess cooling energy It is advantageous that a means of adjustment allows the subject wearing the garment to regulate the cooling power that is brought to him.

It is advantageous that said adjustment is a faucet placed in the circuit of the garment allowing one to increase the pressure drop of main circuit and thus to distribute flows part for the vest and part for the secondary circuit.

It is advantageous that at least two garments carried by at least two subjects are placed in parallel on the circuit and each one comprises an independent adjustment means of flow and therefore cooling power according to the desire of each subject and this is accomplished using only one container.

It is advantageous that the gas coming from the sublimation of the block is sent preferentially on the internal part of a visor so as to demist it.

It is advantageous that the gas coming from the sublimation of the block is used to reduce the oxygen partial pressure of the gas constituting the confined atmosphere of a seal tight suit.

BRIEF DESCRIPTION OF THE DRAWINGS

The invention will be better understood by the detailed description of a mode of realization illustrated by the FIG. 1

The FIG. 1 presents an example of realization of a mode of realization following the invention.

Figure 2:
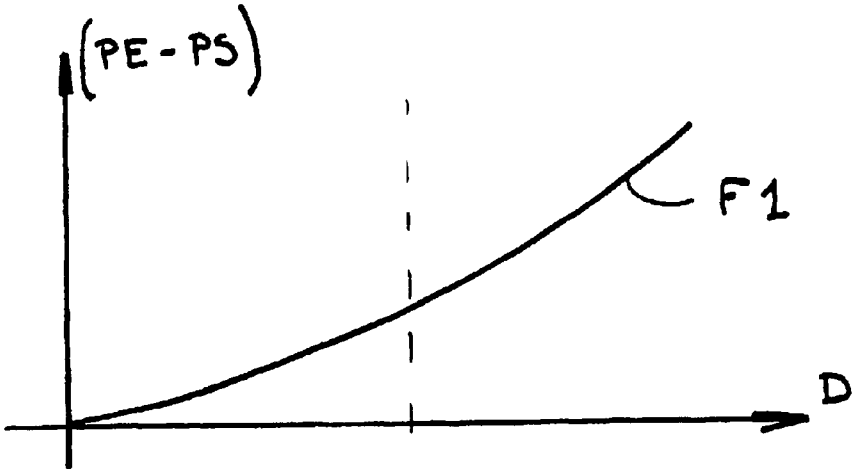

The FIG. 2 presents an example of function F1 binding the flow of fluid carrying the thermal energy with the differential pressure existing between the entry and the exit of the vest.

Figure 3:
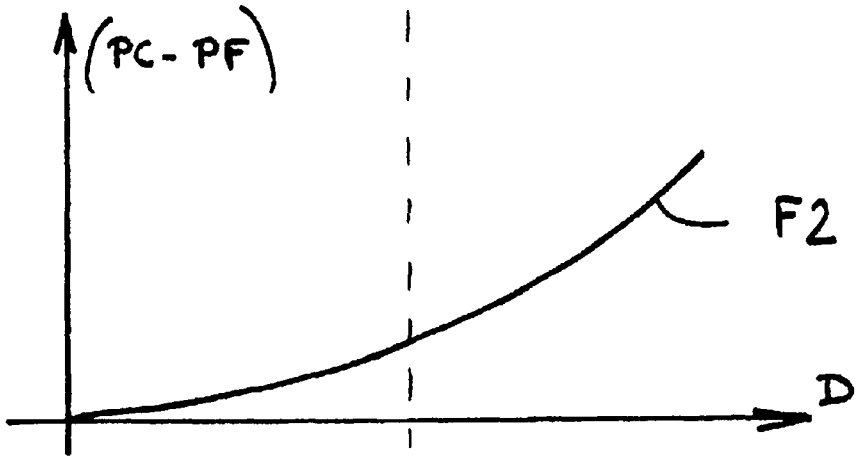

The FIG. 3 presents an example of function F2 binding the flow of fluid carrying the thermal energy with the differential pressure existing between the entry and the exit of the container.

Figure 4:
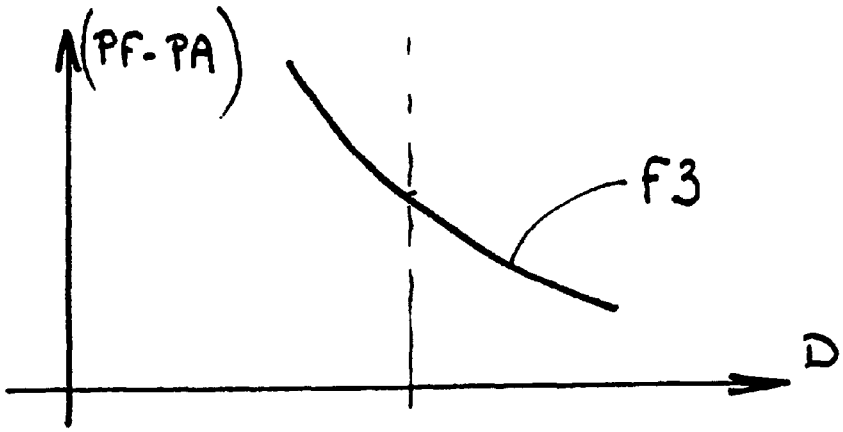

The FIG. 4 presents an example of function binding the flow of fluid carrying the thermal energy with the differential pressure existing between the entry and the exit of the pump.

DETAILED DESCRIPTION OF THE PREFERRED EMBODIMENTS

Figure 1:
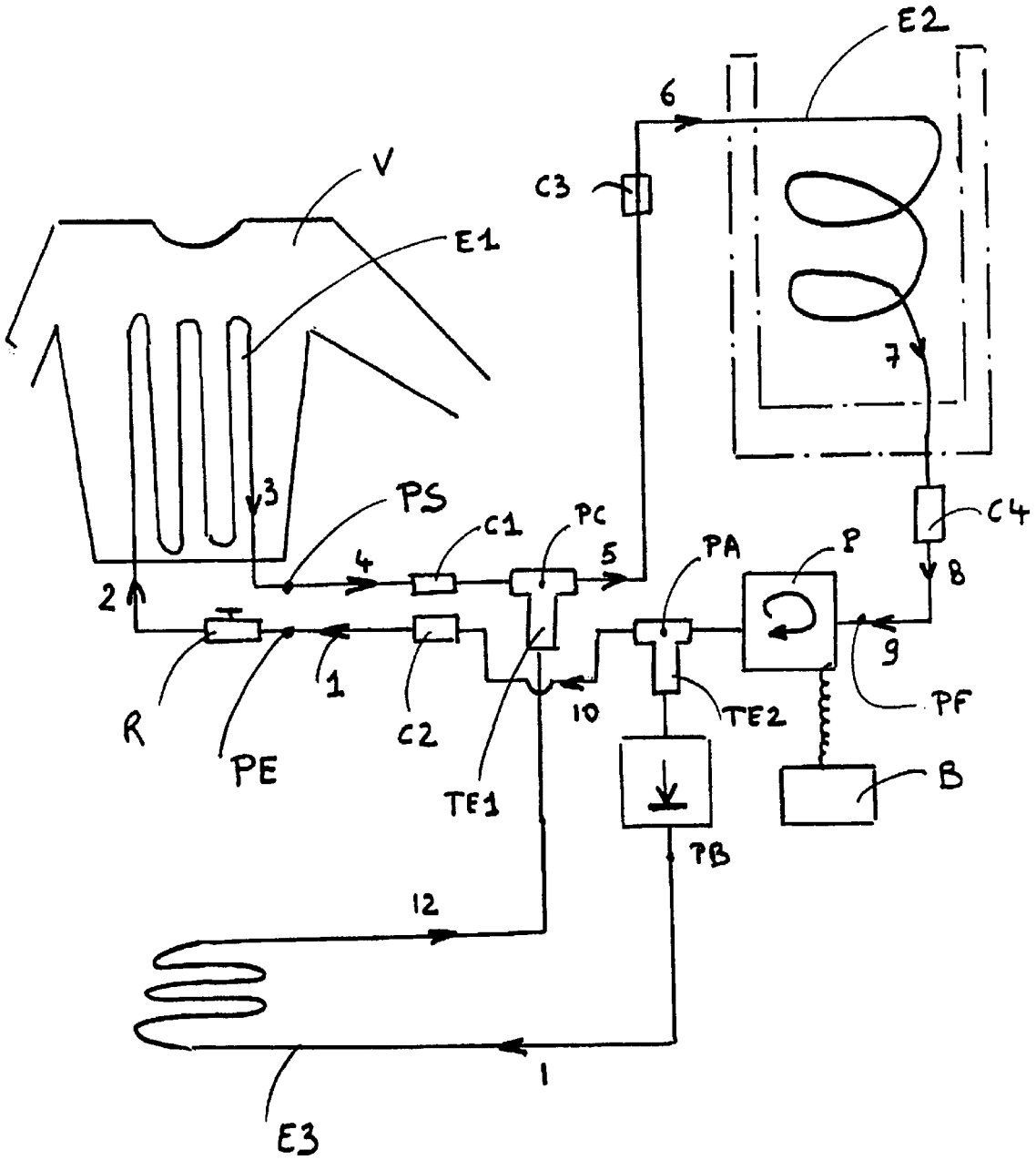

The detailed description that follows is a preferred mode of realization, and refers to FIG. 1. As shown on FIG. 1, a heat exchanger E1 comprising pipes is placed near the body of a porter. A water based fluid carrying the thermal energy circulates in the heat exchanger E1. Two connectors/disconnectors C1 and C2 are placed respectively at the entry and at the exit of the heat exchanger E1.

A heat exchanger E2 is placed inside a thermally insulated container, not necessarily seal tight, and allows one to lower the temperature of the fluid carrying the thermal energy by the block of solid CO2 placed inside the container.

A pump P fed by an electrical source of low power, which can be a battery B, forces the fluid carrying the thermal energy to circulate in the heat exchanger E1 and the heat exchanger E2 situated in the container. Connectors C3 and C4 can be placed at the entry and at the exit of the container. The surface of contact, the thickness of walls, the thermal exchange coefficient of the two heat exchangers E1 and E2 are chosen in order that thermal exchange performances and cost and characteristics of flow and pressure of the pump allows a cooling power equal to about 400 Watt while respecting physiological constraints linked to human factors. In this case it is necessary that the product K1 is about six time superior to K2 where $$K1=s1/((e1)(ct1))$$

where s1 is the surface of exchange of the heat exchanger E1 e1 is the thickness of walls of the heat exchanger E1 ct1 is the thermal exchange coefficient of the material constituting the heat exchanger E1 and where $$K2=s2/((e2)(ct2))$$

where s2 is the surface of exchange of the heat exchanger E2 e2 is the thickness of walls of the heat exchanger E2 ct2 is the thermal exchange coefficient of the material constituting heat exchanger E2

A secondary circuit comprising a valve PB generally closed allows one to direct the fluid carrying the thermal energy towards a heat exchanger E3. A faucet R enables the adjustment of the freezing power provided to the subject.

The reader will understand that many variant applications of this concept exist. The most important applications are the efficient cooling of rescuers in toxic or hot atmosphere with or without a leak tight protection suit and the cooling of pilots in humid and/or hot atmospheres.

I claim:

1. An individual cooling system comprising:

a garment worn near a body of a subject comprising several fine pipes forming a garment circuit in which circulates a fluid carrying a cooling energy and solidifying at a solidification temperature and bringing the cooling energy to the subject, said garment having characteristics of a pressure drop as a function of a flow of the fluid following a relation:

$$D=F1(PE-PS)$$

where

D is a flow of the fluid in the garment circuit,

PE is a pressure at an entry of the garment circuit,

PS is a pressure at an exit of the garment circuit, and

F1 is a function that links the flow and the pressure drop of the garment circuit;

a thermally insulating container containing a substance liberating a quantity of cooling energy by phase change and containing a heat exchanger having the following characteristics of flow in a heat exchanger circuit as a function of pressure drop:

$$D=F2(PC-PF)$$

where

D is a flow of the fluid carrying the cooling energy,

PC is a fluid pressure at a container entry of the heat exchanger circuit,

PF is a fluid pressure at a container exit of the heat exchanger circuit,

F2 is a function that links the flow and a pressure drop of the heat exchanger circuit;

a pump moving the fluid carrying cooling energy in the garment circuit and in the heat exchanger circuit, said pump having the following characteristics of flow as a function of differential pressure:

$$D=F3(PF-PA)$$

where

D is a flow of the fluid carrying cooling energy in the pump,

PA is a pressure at an entry of the pump,

PF is a pressure at an exit of the pump, and

F3 is a function that links the flow and a differential pressure of the pump;

wherein said substance generating cooling energy by phase change has a phase change temperature, and wherein the solidification temperature of the fluid is greater by at least 10 degrees Celsius to the phase change temperature; and wherein the garment circuit and the heat exchanger circuit have thermal characteristics such that the fluid carrying the thermal energy, in normal use, never reaches the solidification temperature thereof while allowing a satisfying transfer of cooling energy from the substance to the subject even though the fluid carrying thermal energy has a temperature of solidification greater than at least 10 degrees Celsius of the phase change temperature of the substance generating cooling energy by phase change.

2. An individual refrigeration system according to claim 1 wherein said heat exchanger circuit includes pipes which are placed such that the fluid at low temperature and the fluid relatively warmer having circulated in the garment, are placed side by side so that the average local temperature is as constant as possible at every point of the heat exchanger.

3. An individual refrigeration system according to claim 1 wherein the fluid carrying the cooling energy is a mixture of water and antifreeze having a solidification temperature equal to about −35° C.; and wherein the substance is a block of carbon dioxide at a temperature equal to about −78° C.

4. An individual refrigeration system according to claim 1, wherein said container is placed in a vehicle and said system further comprises:

a quick connector for connecting and disconnecting the garment circuit to and from the container; and a device for preventing the fluid carrying the cooling energy to solidify in case of disconnection of the garment circuit from the container.

5. An individual refrigeration system according to claim 4 where said device is a circuit placed in parallel and comprising:

a valve having an opening threshold set at a value of between 0.25 bar and 1 bar; and a heat exchanger allowing automatic evacuation of an excess cooling energy.

6. An individual refrigeration system according to claim 4 wherein an adjustment device allows the subject to regulate a cooling power of the garment circuit.

7. An individual refrigeration system according to claim 6 wherein said adjustment device is a faucet placed in the garment circuit allowing an increase in the pressure drop thereof and thus distributing the flows for the garment and for the container.

8. An individual refrigeration system according to claim 4 wherein there are at least two said garments carried by at least two respective subjects which respective said garment circuits are placed in parallel on the heat exchanger circuit, each garment circuit comprising an independent adjustment device for the flow of the fluid and therefore cooling power according to a desire of each subject.

9. An individual refrigeration system according to claim 1 wherein a gas coming from a sublimation of the substance generating cooling energy by phase change is sent preferentially on an internal part of a visor worn by the subject in order to demist the visor.

10. An individual refrigeration system according to claim 1 wherein a gas coming from a sublimation of the substance generating cooling energy by phase change is used to decrease an oxygen partial pressure of a gas constituting a confined atmosphere of a seal tight suit worn by the user.

11. An individual cooling system comprising:

a garment worn near a body of a subject comprising several fine pipes forming a garment circuit in which circulates a fluid carrying a cooling energy and solidifying at a solidification temperature and bringing the cooling energy to the subject, said garment having characteristics of a pressure drop as a function of a flow of the fluid following a relation:

$$D=F1(PE-PS)$$

where

D is a flow of the fluid in the garment circuit,

PE is a pressure at an entry of the garment circuit

PS is a pressure at an exit of the garment circuit, and

F1 is a function that links the flow and the pressure drop of the garment circuit;

a thermally insulating container containing a substance liberating a quantity of cooling energy by phase change and containing a heat exchanger having the following characteristics of flow in a heat exchanger circuit as a function of pressure drop:

$$D=F2(PC-PF)$$

where

D is a flow of the fluid carrying the cooling energy,

PC is a fluid pressure at a container entry of the heat exchanger circuit,

PF is a fluid pressure at a container exit of the heat exchanger circuit,

F2 is a function that links the flow and a pressure drop of the heat exchanger circuit;

a pump moving the fluid carrying cooling energy in the garment circuit and in the heat exchanger circuit, said pump having the following characteristics of flow as a function of differential pressure:

$$D=F3(PF-PA)$$

where

D is a flow of the fluid carrying cooling energy in the pump,

PA is a pressure at an entry of the pump,

PF is a pressure at an exit of the pump, and

F3 is a function that links the flow and a differential pressure of the pump;

wherein said substance generating cooling energy by phase change has a phase change temperature, and wherein the solidification temperature of the fluid is greater by at least 10 degrees Celsius to the phase change temperature; and wherein the garment circuit and the heat exchanger circuit have thermal characteristics such that a garment coefficient K1 is three to ten times greater than a heat exchanger circuit coefficient K2 where:

$$K1=s1/((e1)(ct1))$$

where s1 is a surface of exchange of the garment circuit, e1 is a thickness of walls of the garment circuit, and ct1 is a thermal exchange coefficient of a material constituting the garment circuit, and where $$K2=s2/((e2)(ct2))$$

where s2 is a surface of exchange of the heat exchanger circuit, e2 is a thickness of walls of the heat exchanger circuit, and ct2 is a thermal exchange coefficient of a material constituting heat exchanger circuit;

whereby the fluid carrying the thermal energy, in normal use, never reaches the solidification temperature thereof while allowing a satisfying transfer of cooling energy from the substance to the subject even though the fluid carrying thermal energy has a temperature of solidification greater than at least 10 degrees Celsius of the phase change temperature of the substance generating cooling energy by phase change.

12. An individual refrigeration system according to claim 11 wherein said heat exchanger circuit includes pipes which are placed such that the fluid at low temperature and the fluid relatively warmer having circulated in the garment, are placed side by side so that the average local temperature is as constant as possible at every point of the heat exchanger.

13. An individual refrigeration system according to claim 11 wherein the fluid carrying the cooling energy is a mixture of water and antifreeze having a solidification temperature equal to about −35° C.; and wherein the substance is a block of carbon dioxide at a temperature equal to about −78° C.

14. An individual refrigeration system according to claim 11, wherein said container is placed in a vehicle and said system further comprises:

a quick connector for connecting and disconnecting the garment circuit to and from the container; and a device for preventing the fluid carrying the cooling energy to solidify in case of disconnection of the garment circuit from the container.

15. An individual refrigeration system according to claim 14 where said device is a circuit placed in parallel and comprising a valve having an opening threshold set at a value of between 0.25 bar and 1 bar; and a heat exchanger allowing automatic evacuation of an excess cooling energy.

16. An individual refrigeration system according to claim 14 wherein an adjustment device allows the subject to regulate a cooling power of the garment circuit.

17. An individual refrigeration system according to claim 16 wherein said adjustment device is a faucet placed in the garment circuit allowing an increase in the pressure drop thereof and thus distributing the flows for the garment and for the container.

18. An individual refrigeration system according to claim 14 wherein there are at least two said garments carried by at least two respective subjects which respective said garment circuits are placed in parallel on the heat exchanger circuit, each garment circuit comprising an independent adjustment device for the flow of the fluid and therefore cooling power according to a desire of each subject.

19. An individual refrigeration system according to claim 11 wherein a gas coming from a sublimation of the substance generating cooling energy by phase change is sent preferentially on an internal part of a visor worn by the subject in order to demist the visor.

20. An individual refrigeration system according to claim 11, wherein a gas coming from a sublimation of the substance generating cooling energy by phase change is used to decrease an oxygen partial pressure of a gas constituting a confined atmosphere of a seal tight suit worn by the user.

* * * * *